US006837724B2

(12) United States Patent
McDaid et al.

(10) Patent No.: US 6,837,724 B2
(45) Date of Patent: Jan. 4, 2005

(54) ELECTRICAL CONNECTOR WITH AN INTERNAL SWITCH

(75) Inventors: Padraig McDaid, Limerick (IE); Declan McInerney, Clare (IE); John M. Horgan, Limerick (IE); Marko F. Spiegel, LaFox, IL (US); John Wallace, Limerick (IE)

(73) Assignee: Molex Incvorporated, Lisle, IL (US)

( * ) Notice: Subject to any disclaimer, the term of this patent is extended or adjusted under 35 U.S.C. 154(b) by 33 days.

(21) Appl. No.: 10/185,760

(22) Filed: Jun. 27, 2002

(65) Prior Publication Data

US 2004/0002245 A1 Jan. 1, 2004

(51) Int. Cl.[7] ..... H01R 29/00
(52) U.S. Cl. ..... 439/188
(58) Field of Search ..... 439/188, 374, 439/578, 700, 844, 916, 944, 63

(56) References Cited

U.S. PATENT DOCUMENTS 5,936,581 A * 8/1999 Roshitsh et al. ..... 343/702
6,142,803 A * 11/2000 Bozzer et al. ..... 439/188
6,473,045 B1 * 10/2002 Duquerroy et al. ..... 343/702
2001/0005645 A1 6/2001 Zech et al.

FOREIGN PATENT DOCUMENTS

| | | |
|---|---|---|
| DE | 100 57 058 A1 | 5/2002 |
| EP | 1 009 067 A2 | 6/2000 |
| EP | 1187267 A2 | 3/2002 |

* cited by examiner

*Primary Examiner*—Truc T. Nguyen
*Assistant Examiner*—James R. Harvey
(74) *Attorney, Agent, or Firm*—Stephen Z. Weiss

(57) ABSTRACT

An electrical connector is provided with an integral switch. The connector includes a dielectric housing having a mating end. A fixed switch contact is immovably mounted on the housing. A movable switch contact is mounted on the housing and includes a contact portion movable into and out of switching engagement with the fixed switch contact. The movable switch contact includes a movable terminal portion at the mating end of the housing for engaging an appropriate terminal of a complementary mating connector. The movable terminal portion is integral with the contact portion for moving the contact portion relative to the fixed switch contact in response to mating of the connectors.

23 Claims, 3 Drawing Sheets

ELECTRICAL CONNECTOR WITH AN INTERNAL SWITCH

FIELD OF THE INVENTION

This invention generally relates to the art of electrical connectors and, particularly, to an electrical connector assembly which has an internal switch.

BACKGROUND OF THE INVENTION

Various electrical connector assemblies have integral or internal switches which signal a change in circuit condition upon mating of a pair of connectors. Typically, the pair of connectors have complementary interconnecting terminals which engage and establish a circuit through the connector assembly when the connectors are mated. In addition, one or both of the mating connectors may have a pair of switch contacts which may be normally closed or normally open. One of the switch contacts is a movable contact on one of the mating connectors and which is in the path of movement of the other mating connector, whereupon the switch contacts are moved from their normally closed or normally open condition upon mating of the connectors to signal a change in a given circuit condition.

One application of circuit switching is in signal transmission connectors which use antennas for receiving given signals. The system may include an external antenna. For instance, a mobile cell phone has its own (external) antenna. It also may be desirable to connect the mobile phone to an internal antenna, such as on an automobile. Consequently, when the internal antenna is connected to the system, a separate switch is activated to disconnect the external antenna. The present invention is directed to such a switching arrangement which eliminates any separate switches and incorporates a switch from the external antenna to the internal antenna, directly into the signal transmission circuit.

SUMMARY OF THE INVENTION

An object, therefore, of the invention is to provide a new and improved electrical connector with an integral switch.

In the exemplary embodiment of the invention, the connector includes a dielectric housing having a mating end. A fixed switch contact is immovably mounted on the housing. A movable switch contact is mounted on the housing and includes a contact portion movable into and out of switching engagement with the fixed switch contact. The movable switch contact includes a movable terminal portion at the mating end of the housing for engaging an appropriate terminal of a complementary mating connector. The movable terminal portion is integral with the contact portion for moving the contact portion relative to the fixed switch contact in response to mating of the connectors.

According to one aspect of the invention, the terminal portion of the movable switch contact comprises a terminal pin. The fixed switch contact includes an aperture through which the terminal pin movably extends. The housing includes a terminal-receiving passage aligned with the aperture and through which the terminal pin freely extends for engaging the terminal of the complementary mating connector.

As disclosed herein, the switch contacts have feet portions projecting from the housing for connection to appropriate circuit traces on a printed circuit board. A shield is disposed about the mating end of the housing. The shield includes a receptacle in registry with the mating end of the housing for receiving the complementary mating connector. The movable terminal portion of the movable switch contact projects into the receptacle. The shield has feet portions for connection to appropriate ground circuit traces on the printed circuit board.

The invention contemplates that the fixed switch contact which is immovably mounted on the housing can be connected to an external antenna. The movable switch contact, through its movable terminal portion, is effective to engage the terminal of the complementary mating connector which is connected to an internal antenna. Therefore, as the internal antenna is moved into engagement with the movable switch contact, the external antenna is disconnected.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
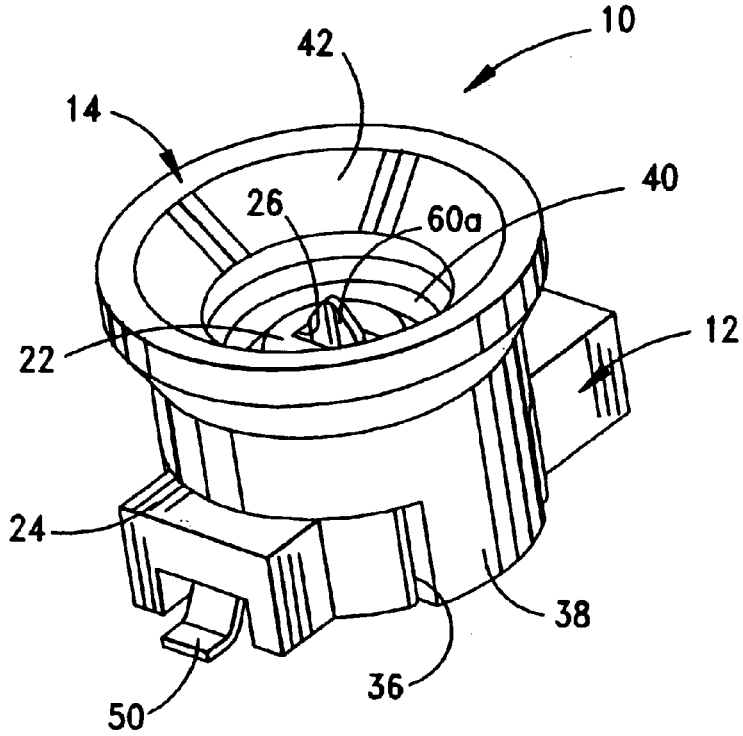
FIG. 1 is a top perspective view of an electrical connector incorporating the integral or internal switch of the invention.
Figure 2:
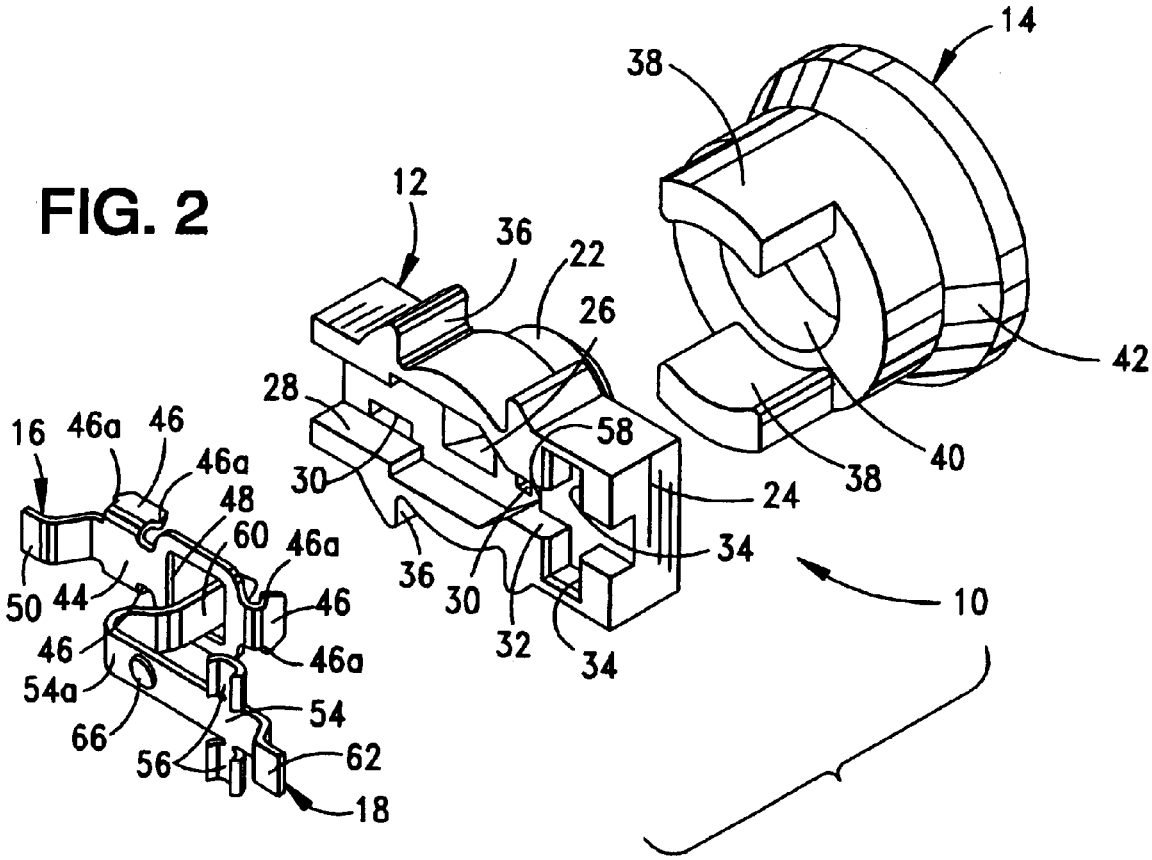
FIG. 2 is a bottom exploded perspective view of the components of the connector in FIG. 1.
Figure 3:
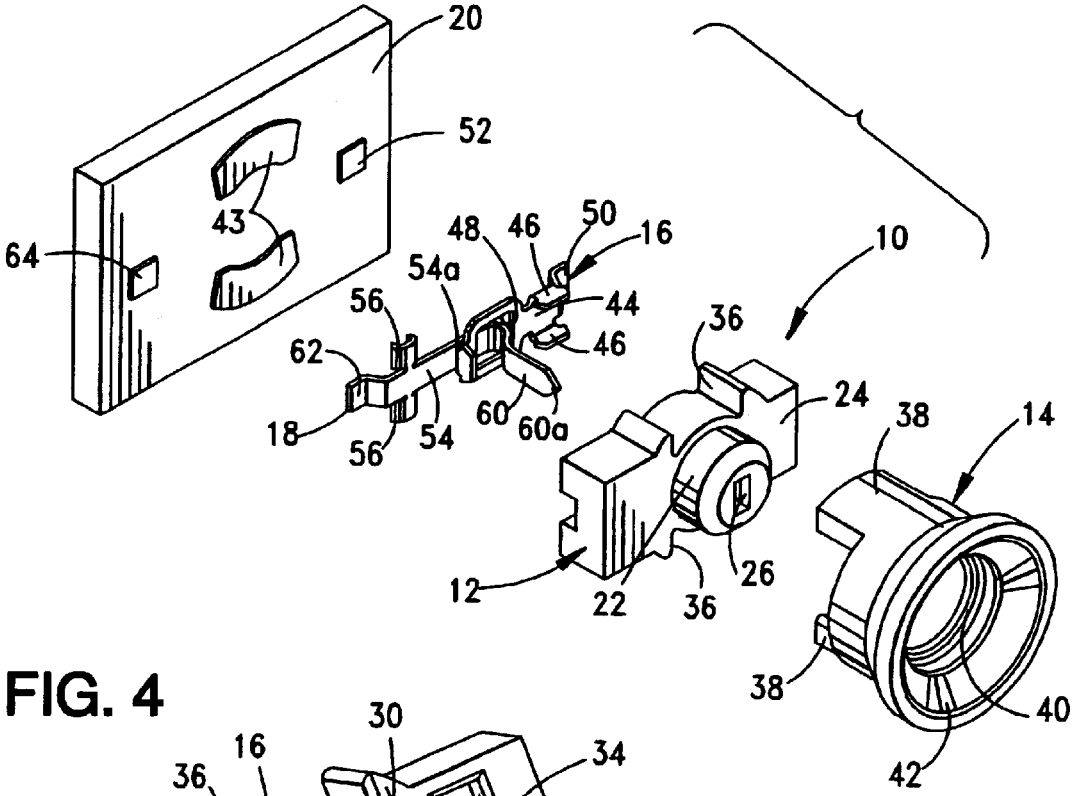
FIG. 3 is a top perspective view of the components of the connector in conjunction with a printed circuit board.

Referring to the drawings in greater detail, and first to FIGS. 1–3, the invention is incorporated in an electrical connector, generally designated 10, which includes a dielectric housing, generally designated 12, onto which is mounted a conductive shield, generally designated 14. Housing 12 mounts a fixed switch contact, generally designated 16, and a movable switch contact, generally designated 18. The switch contacts are connected to circuit traces on a printed circuit board 20, as described hereinafter. Connector 10 may be on a mobile cell phone, for instance.

More particularly, housing 12 of connector 10 is a one-piece structure which can be molded of dielectric material such as plastic or the like. The housing includes a mating end 22 which projects upwardly from a main body 24. A terminal-receiving passage 26 extends completely through the main body and the mating end. As best seen in FIG. 2, the bottom of housing 12 is recessed to define a trough 28 and a plurality of slots 30 for mounting fixed switch contact 16, as described hereinafter. A trough 32 having a pair of wing portions 34 also are formed in the bottom of the housing for mounting movable switch contact 18, as described hereinafter. Finally, the housing is molded with a pair of channels 36 on opposite sides of body 24 for positioning shield 14.

Shield 14 of connector 10 is fabricated of metallic material and is mounted over housing 12 by positioning a pair of legs 38 into channels 36 on opposite sides of body 24 of the housing. The shield includes an opening or receptacle 40 which surrounds mating end 22 of housing 12 and which also receives a complementary mating connector, as described hereinafter. With the receptacle being in registry with the mating end of the housing, terminal-receiving passage 26 in the mating end is exposed within the receptacle. The shield has an outwardly flared mating end 42 for facilitating guiding the complementary mating connector into receptacle 40. Legs 38 are connected, as by soldering, to a pair of ground circuit pads 43 on circuit board 20.

Fixed switch contact 16 includes a body portion 44 which becomes fixed within trough 28 at the underside of housing 12 by press-fitting three barbs 46 into slots 30 in the housing. The barbs have teeth 46*a* for skiving into the plastic material of the housing to rigidly secure fixed contact 16 to the housing. An aperture 48 is formed through body portion 44 of the fixed switch contact. Finally, the fixed switch contact has a foot portion 50 for connection, as by soldering, to a circuit pad 52 (FIG. 3) on circuit board 20 (FIG. 3). The entire fixed switch contact may be stamped and formed of conductive sheet metal material.

Within an antenna switching system to which electrical connector 10 is readily applicable, fixed switch contact 16 is connected through circuit board 20 to an external antenna of the system, such as the external antenna of a mobile cell phone. In other words, circuit pad 52 is coupled through appropriate circuit traces (not shown) on circuit board 20 to appropriate circuitry leading to the external antenna on the mobile unit. With foot 50 of the fixed switch contact connected to circuit pad 52, the fixed switch contact becomes the external antenna contact of the switching system for the mobile unit.

Movable switch contact 18 of connector 10 includes a body portion 54 which is positioned within trough 32 (FIG. 2) at the underside of body 24 of housing 12. A pair of securing wings 56 project outwardly from opposite sides of body portion 54 and are press-fit into wing portions 34 of trough 32. It can be seen in FIG. 2 that the bottom of trough 32 terminates inwardly at a ledge 58. Body portion 54 of movable switch contact 18 projects inwardly beyond edge 58 so that the inner end 54*a* of the body portion effectively is a flexible contact arm. A movable terminal portion in the form of a terminal pin 60 is integral with and projects upwardly from contact arm 54*a* and through aperture 48 in fixed switch contact 16. Terminal pin 60 proceeds to project upwardly through passage 26 in mating end 22 of housing 12 whereupon terminal pin 60 is exposed above the mating end as can be seen in FIG. 1. Finally, movable switch contact 18 has a foot portion 62 for connection, as by soldering, to a circuit pad 64 on circuit board 20.

Within the antenna switching system with which connector 10 is described herein, movable switch contact 18 is the terminal of the connector which moves between connection to the external antenna, through fixed switch contact 16, and connection to the internal antenna as described below.

Figure 4:
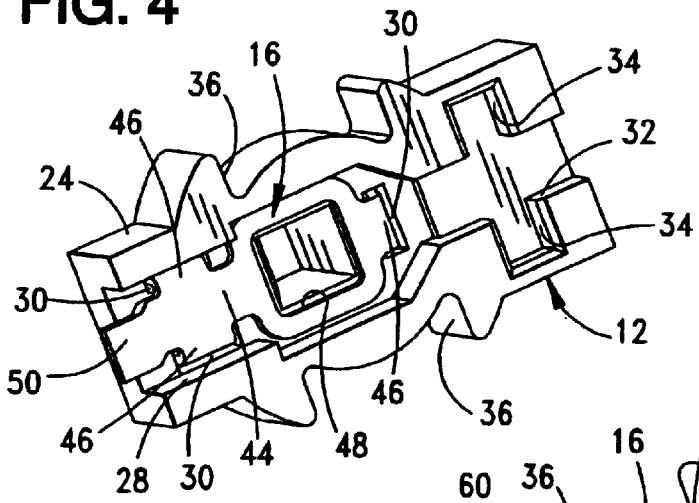
FIG. 4 is a bottom perspective view of the connector housing mounting the fixed switch contact.
Figure 5:
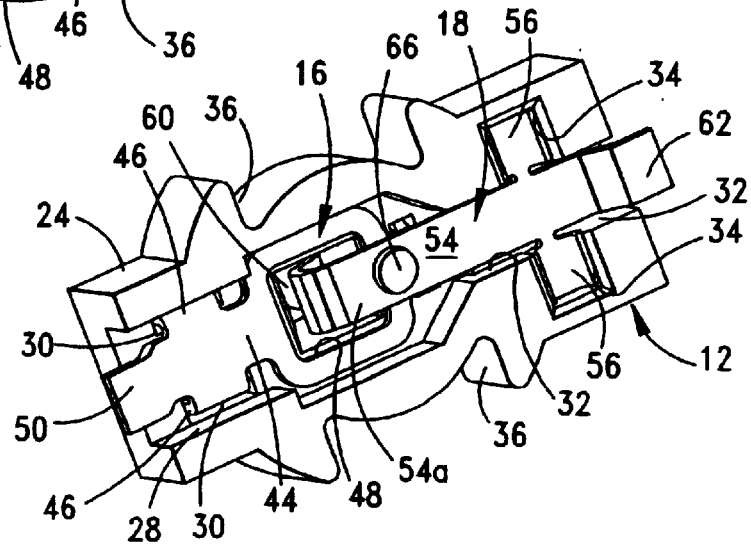
FIG. 5 is a view similar to that of FIG. 4, with the movable contact added.
Figure 6:
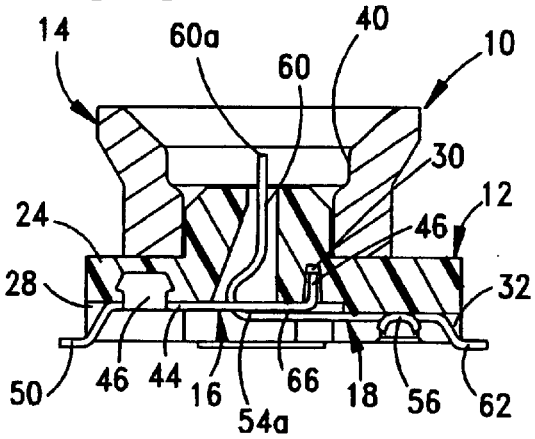
FIG. 6 is a vertical section through the connector of FIG. 1, with the internal switch in its normally closed condition.

In assembly, fixed switch contact 16 is mounted within trough 28 at the underside of housing 12 as seen in FIG. 4. Toothed barbs 46 are press-fit into slots 30 in the housing. Movable switch contact 18 then is assembled into trough 32 at the bottom of the housing as shown in FIG. 5. Securing wings 56 are press-fit into wing portions 34 of the trough. When so assembled, securing wings 56 sort of act as fulcrums about which contact arm 54*a* can flex along with integral terminal pin 60 that extends through aperture 48 in the fixed switch contact and upwardly into the connector, as described above. This can seen in the fully assembled depiction of FIG. 6 which shows the normally closed condition of fixed switch contact 16 and movable switch contact 18. The movable switch contact has a rounded, upwardly projecting boss 66 for establishing a positive contact with the fixed switch contact.

Figure 7:
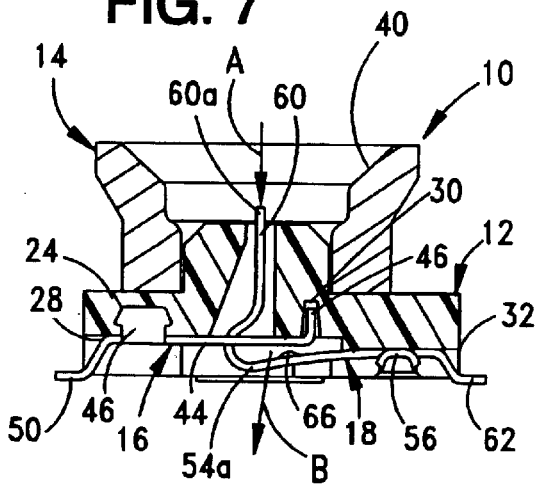
FIG. 7 is a view similar to that of FIG. 6, with the switch in its open condition.

FIG. 7 shows movable switch contact 18 having been moved to an open condition relative to fixed switch contact 16. This occurs when an axial force is applied in the direction of arrow "A" to a distal end 60*a* of integral terminal pin 60 of movable switch contact 18. In essence, contact arm 54*a* flexes downwardly about the fulcrum defined by securing wings 56 to move contact boss 66 downwardly in the direction of arrow "B" and out of contact with fixed switch contact 16.

Figure 8:
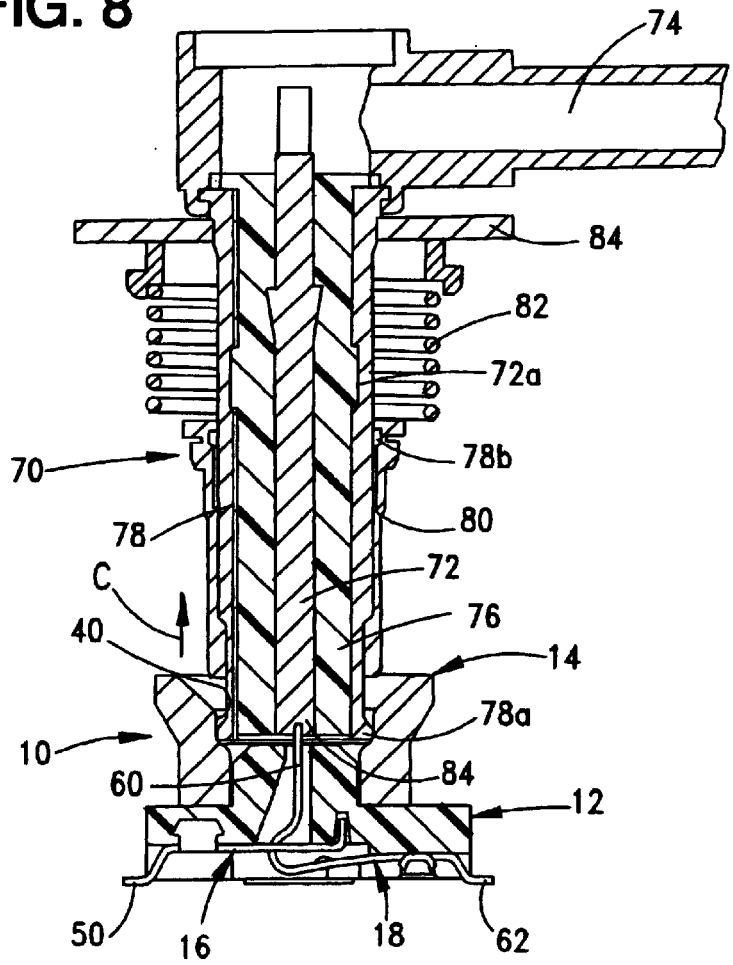
FIG. 8 is a view similar to that of FIG. 7, with the connector mated to a complementary mating connector adapted for coupling to an internal antenna.

FIG. 8 shows an aspect of the invention wherein a complementary mating connector, generally designated 70, is mated within receptacle 40 defined by shield 14 of connector 10. The configuration of mating connector 70 can vary considerably. Suffice it to say, the mating connector includes a central terminal 72 which is coupled through appropriate connections to a coaxial cable 74 and to an internal antenna (not shown). For instance, connector 70 may be a fixed connector in a cell phone base unit of an automobile. Terminal 70 is mounted within a dielectric 76 which is surrounded by and fixed to, as at 72*a*, to a shield 78. When mated to connector 10, a distal end 78*a* of the shield is inserted into receptacle 40 of shield 14 of connector 10, whereby the two shields of the mating connectors are commoned. Shield 78 is fixed, as at 78*b*, to a ring 80 which engages one end of a coil spring 82. The bottom end of terminal pin 72 has a recess 84 for receiving distal end 60*a* of terminal pin 60 of movable switch contact 18 of connector 10.

With connector 10 fixed to circuit board 20 in the mobile cell phone unit, mating connector 70 is maintained in mated condition with connector 10 by coil spring 82 which abuts against a fixed frame piece 84 on the automobile. The entire assembly of terminal pin 72, dielectric 76, shield 78 and ring 80 move in the direction of arrow "C", relative to fixed frame piece 84, against the biasing of spring which maintains the connectors in mated condition, as the mobile unit and connector 10 are seated and/or latched in the base unit of the automobile.

In the mated condition of connectors 10 and 70, when terminal pin 60 of movable switch contact 18 engages terminal pin 72 of connector 70, to coupled the movable switch contact to the internal antenna, the external antenna automatically is disconnected by moving movable switch contact 18 away from fixed switch contact 16.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector with an integral switch, comprising:

a dielectric housing having a mating end;

a fixed switch contact including an aperture immovably mounted on the housing;

a movable switch contact mounted on the housing and including a contact portion movable into and out of switching engagement with the fixed switch contact; and said movable switch contact having a free end and a fixed end including a movable terminal portion at the free end of the movable switch contact and at the mating end of the housing, designed to movably extend through the aperture in the fixed switch contact, for engaging an appropriate terminal of a complementary mating connector, the movable terminal portion being integral with and extending from the contact portion for moving the contact portion relative to the fixed switch contact in response to mating of the connectors, the moveable switch contact further including a point for establishing a positive contact with the fixed switch contact located between the free end and the fixed end of the movable switch contact, which contact point moves out of engagement with the fixed switch contact when the contact portion moves relative to the fixed switch contact.

2. The electrical connector of claim 1 wherein the terminal portion of said movable switch contact comprises a terminal pin.

3. The electrical connector of claim 2 wherein said housing includes a terminal-receiving passage aligned with said aperture and through which the terminal pin freely extends.

4. A The electrical connector of claim 1, including a shield about at least said mating end of the housing.

5. The electrical connector of claim 4 wherein said shield includes a receptacle in registry with the mating end of the housing for receiving said complementary mating connector.

6. The electrical connector of claim 5 wherein said movable terminal portion of the movable switch contact projects into said receptacle.

7. The electrical connector of claim 1 wherein said fixed switch contact includes a fixed body portion having said aperture therethrough, said movable switch contact includes a body portion mounted to the housing and a flexible contact arm defining said movable portion engageable with the fixed switch contact, and said movable terminal portion extends through the aperture in the body portion of the fixed switch contact.

8. The electrical connector of claim 7 wherein the terminal portion of said movable switch contact comprises a terminal pin.

9. An electrical connector with an integral switch, comprising:

a dielectric housing for mounting on a printed circuit board, the housing having a mating end;

a fixed switch contact having a body portion immovably mounted on the housing, an aperture through the body portion and a foot portion projecting from the housing for connection to an appropriate circuit trace on the printed circuit board;

a movable switch contact having a body portion mounted on the housing and a flexible contact arm defining a contact portion movable into and out of switching engagement with the fixed switch contact, and a foot portion projecting from the housing for connection to an appropriate circuit trace on the printed circuit board; and said movable switch contact including a movable terminal portion extending through the aperture on the body portion of the fixed switch contact and to the mating end of the housing for engaging an appropriate terminal of a complementary mating connector, the movable terminal portion being integral with and extending from the contact portion for moving the contact portion relative to the fixed switch contact in response to mating of the connectors.

10. The electrical connector of claim 9 wherein the terminal portion of said movable switch contact comprises a terminal pin.

11. The electrical connector of claim 10 wherein said housing includes a terminal-receiving passage aligned with the aperture in the fixed switch contact and through which the terminal pin freely extends.

12. The electrical connector of claim 9, including a shield about at least said mating end of the housing.

13. The electrical connector of claim 12 wherein said shield includes a receptacle in registry with the mating end of the housing for receiving said complementary mating connector.

14. The electrical connector of claim 13 wherein said movable terminal portion of the movable switch contact projects into said receptacle.

15. The electrical connector of claim 12 wherein said shield includes at least one leg for connection to an appropriate ground trace on the printed circuit board.

16. An electrical connector assembly having an internal switch, comprising:

a first connector including a housing having a mating end with a first terminal thereat; and a second connector including a housing having a mating end for mating with the mating end of the first connector, a fixed switch contact including an aperture immovably mounted on the housing of the second connector, a movable switch contact mounted on the housing of the second connector and including a contact portion movable into and out of switching engagement with the fixed switch contact, and said movable switch contact having a free end and a fixed end including a movable terminal portion at the free end of the movable switch contact and at the mating end of the housing of the second connector, designed to movably extend through the aperture in the fixed switch contact, for engaging the first terminal of the first connector, the movable terminal portion being integral with and extending from the contact portion for moving the contact portion relative to the fixed switch contact in response to mating of the connectors, the moveable switch contact further including a point for establishing a positive contact with the fixed switch contact located between the free end and the fixed end of the movable switch contact, which contact point moves out of engagement with the fixed switch contact when the contact portion moves relative to the fixed switch contact.

17. The electrical connector assembly of claim 16 wherein the terminal portion of said movable switch contact comprises a terminal pin having a distal end.

18. The electrical connector assembly of claim 17 wherein the first terminal of said first connector has a recess for receiving the distal end of said terminal pin.

19. The electrical connector of claim 16 wherein said fixed switch contact includes a fixed body portion having an aperture therethrough, said movable switch contact includes a body portion mounted to the housing and a flexible contact arm defining said movable portion engageable with the fixed switch contact, and said movable terminal portion extends through the aperture in the body portion of the fixed switch contact.

20. An electrical connector assembly having an internal switch for switching between an external antenna and an internal antenna, comprising:

a first connector including a housing having a mating end with a first terminal thereat, the first terminal being adapted for connection to an internal antenna; and a second connector including a housing having a mating end for mating with the mating end of the first connector, a fixed switch contact including an aperture immovably mounted on the housing of the second connector and adapted for connection to an external antenna, a movable switch contact mounted on the housing and including a contact portion movable into and out of switching engagement with the fixed switch contact, and said movable switch contact having a free end and a fixed end including a movable terminal portion at the free end of the movable switch contact and at the mating end of the housing for engaging the first terminal of the first connector, the movable terminal portion being integral with and extending from the contact portion, designed to movably extend through the aperture in the fixed switch contact, for moving the contact portion relative to the fixed switch contact in response to mating of the connectors, the moveable switch contact further including a point for establishing a positive contact with the fixed switch contact located between the free end and the fixed end of the movable switch contact, which contact point moves out of engagement with the fixed switch contact when the contact portion moves relative to the fixed switch contact whereby the external antenna is disconnected automatically in response to connection with the internal antenna.

21. The electrical connector assembly of claim 20 wherein the terminal portion of said movable switch contact comprises a terminal pin having a distal end.

22. The electrical connector assembly of claim 21 wherein the first terminal of said first connector has a recess for receiving the distal end of said terminal pin.

23. An electrical connector with an integral switch, comprising:

a dielectric housing having a mating end;

a fixed switch contact including an aperture immovably mounted on the housing and feet portions projecting from the housing for connection to appropriate circuit traces on a printed circuit board;

a movable switch contact mounted on the housing and including a contact portion movable into and out of switching engagement with the fixed switch contact; and said movable switch contact having a free end and a fixed end including a movable terminal portion at the free end of the movable switch contact and at the mating end of the housing, designed to movably extend through the aperture in the fixed switch contact, for engaging an appropriate terminal of a complementary mating connector, the movable terminal portion being integral with and extending from the contact portion, located between the free end and the fixed end of the movable switch contact, for moving the contact portion relative to the fixed switch contact in response to mating of the connectors.

* * * * *